United States Patent [19]

Morgan

[11] 4,408,764

[45] Oct. 11, 1983

[54] STICK AND PEG GAME DEVICE

[76] Inventor: Adolph A. Morgan, 932 Garfield Ave., Belvidere, Ill. 61008

[21] Appl. No.: 236,257

[22] Filed: Feb. 20, 1981

[51] Int. Cl.[3] ..... A63B 67/00

[52] U.S. Cl. ..... 273/341

[58] Field of Search ..... 273/341, 411; 280/47.19, 47.26

[56] References Cited

U.S. PATENT DOCUMENTS

| | | | |
|---|---|---|---|
| 3,554,551 | 1/1971 | Apiki | 273/411 |
| 3,817,525 | 6/1974 | Henry | 273/341 |
| 3,876,223 | 4/1975 | O'Reilly et al. | 280/47.19 |
| 4,183,532 | 1/1980 | Iglesias et al. | 273/341 |
| 4,227,710 | 10/1980 | Laub | 280/47.19 |

*Primary Examiner*—William H. Grieb

[57] ABSTRACT

The present invention relates to a stick and peg game device wherein a peg is disposed upon a plate which is disposed on a playing service in such a manner that a player may strike down on the peg with a stick causing the peg to rise permitting the player to repeatedly hit the peg up and then permitting the player to hit the peg into a playing area with scoring dependant upon the number of times the peg is hit upwardly and how far it is hit into the playing field.

1 Claim, 5 Drawing Figures

STICK AND PEG GAME DEVICE

BACKGROUND OF THE INVENTION

Conventional game devices in the general field of WHIFFLE BALL,JARTS, softball, and the like illustrate the usefulness of such games as well as the game contemplated in this invention.

The present invention permits the use of very primitive objects as well as permitting the use of manufactured objects.

SUMMARY

It is therefore an object of the present invention to provide a stick and peg device which includes an elongated stick or bat, a peg, or projectile, a plate, and field indicating means.

An object of the present invention is to provide such a device which may be used wherein the elements are constructed of metal, wood, plastic, rubber, and the like.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein line numberals refer to like parts throughout, and in which;

DETAILED DESCRIPTION OF THE INVENTION

Figure 1:
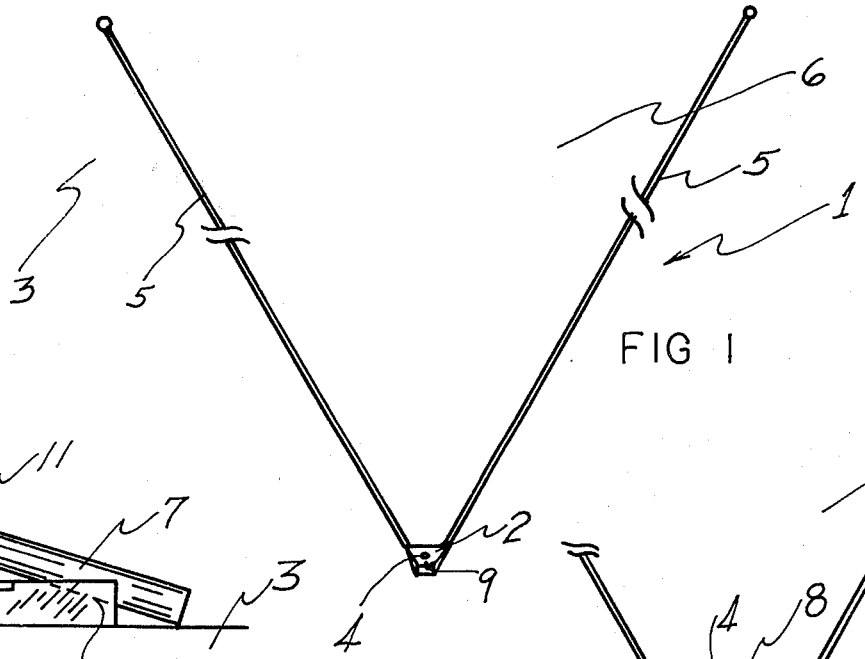
FIG. 1 is a plan view of a part of the stick and peg game device constructed in accordance with and embodying the present invention.

Referring now in more detail any by reference characters to the drawings which illustrate practical embodiments of the present invention, FIGS. 1, 2, 3 and 4 are views which taken together show of a stick and peg game device, 1, constructed in accordance with, used in and embodying the present invention.

As shown in FIG. 1, there is a plate 2, secured to the playing surface 3 by fastener 4 and provided with foul lines 5 which designate the playing area 6.

Figure 2:
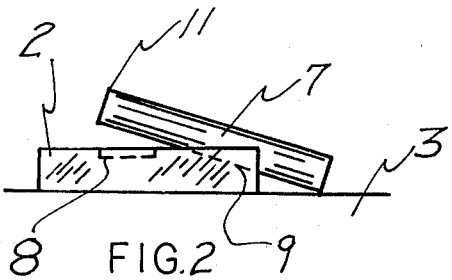
FIG. 2 is an elevation view of a peg and plate used in the device in FIG. 1.
Figure 3:
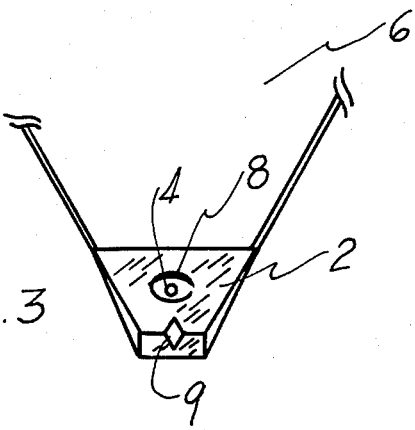
FIG. 3 is another view of a plate used in the device in FIG. 1.
Figure 4:
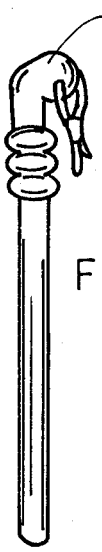
FIG. 4 is an elevation view of a stick used in the device shown in FIG. 1.

FIG. 2 illustrates the plate 2, disposed upon playing surface 3, with peg 7, disposed in it's ready position. As shown in FIG. 3, plate 2 is provided with recess 8 and notch 9 thus permitting the inclination of peg 7 shown in FIG. 2 to be stable. As shown in FIG. 3, the plate may be in the form of a trapezoid wherein the thickness of the plate is reduced uniformly proceeding from the short top to the long base of the trapezoid. FIG. 4 illustrates stick 10 and how personalized it may be made.

The object of the game is to strike down on peg 7 near end 11 with stick 10 causing peg 7 to rise in the air. The next object of the game is to repeatedly hit the peg up into the air and then hit the peg into the playing area 6. Scoring may be based upon the product of the distance of travel into the playing area and the number of times hit into the air.

Stick 10 and peg 7 may be referred to as a bat and projectile respectively. It is clear that the bat and peg may be made of wood, plastic, rubber, or the like as may the plate.

Figure 5:
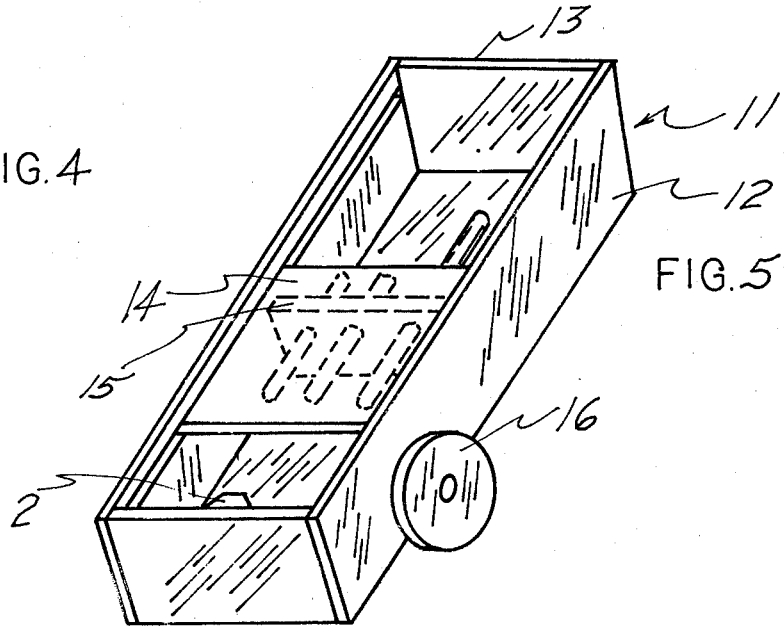
FIG. 5 is a perspective view of a carrying cart for the stick and peg game device, constructed in accordance with an embodying the present invention.

Cart 11, as shown in FIG. 5, is a convenient device for carrying and storing device 1.

Cart 11 includes a frame 12 which is provided with a storage chamber, 13, a sliding cover, 14, rack, 15, and wheels, 16. Plate 2, pegs 7, and stick 10, are shown stored in cart 11.

It should be understood that changes and modifications in the form, construction, arrangement, and combination of the stick and peg game device and methods of making and using the same may be made and substituted for those herein shown and described without departing from the nature and principle of my invention.

Having thus described my invention, what I claim is new and desire to secure by United States Letters Patent is:

1. A stick and peg game device comprising for use on the ground or other surface, plate means, said plate means comprising a flat plate in the form of a trapezoid wherein the thickness of the plate is reduced uniformly proceeding from the short top to the long base of the trapezoid, provided with peg mounting means in the form of a "V" slot in the upper edge of the short top of the trapezoid, peg means operably mounted on said plate means and disposed such that a portion thereof rests in said "V" slot and one end thereof rests on the ground and the other end is free and extends above the upper surface of said plate means, field marking means operably attached to the corners at the ends of the long base of the trapezoid, and stick means.

* * * * *